US005791176A

United States Patent [19]

Montesinos Alonso

[11] Patent Number: 5,791,176

[45] Date of Patent: Aug. 11, 1998

[54] COMBINED ACTUATION LOCK

[75] Inventor: Vicente Montesinos Alonso, Chirivella, Spain

[73] Assignee: C.A.S. Locks, S.L., Chirivella, Spain

[21] Appl. No.: 716,313

[22] PCT Filed: Jan. 26, 1996

[86] PCT No.: PCT/ES96/00016

§ 371 Date: Sep. 27, 1996

§ 102(e) Date: Sep. 27, 1996

[87] PCT Pub. No.: WO96/23131

PCT Pub. Date: Aug. 1, 1996

[30] Foreign Application Priority Data

Jan. 27, 1995 [ES] Spain ..... P9500151

[51] Int. Cl.[6] ..... E05B 47/00

[52] U.S. Cl. ..... 70/277; 70/386; 292/252

[58] Field of Search ..... 70/277–282, 386; 292/144, 201, 252

[56] References Cited

U.S. PATENT DOCUMENTS

| | | | |
|---|---|---|---|
| 3,186,196 | 6/1965 | Moberg | 70/386 X |
| 3,764,172 | 10/1973 | Standke | 292/252 X |
| 4,030,321 | 6/1977 | Kenyon | 70/386 X |
| 4,127,966 | 12/1978 | Schmidt | 292/252 X |
| 4,372,419 | 2/1983 | Barnett et al. | 70/279 |
| 4,483,639 | 11/1984 | McCandless II | 292/252 X |
| 4,586,425 | 5/1986 | Redman et al. | 292/252 X |
| 4,647,089 | 3/1987 | Zangrando | 292/252 X |
| 4,677,834 | 7/1987 | Hicks | 70/386 X |
| 4,702,095 | 10/1987 | Ben-Asher | 70/279 |
| 4,840,049 | 6/1989 | Russo | 70/386 X |
| 4,866,963 | 9/1989 | Leininger et al. | 70/278 |
| 4,946,130 | 8/1990 | Koolman | 70/386 X |
| 5,177,988 | 1/1993 | Bushnell | 292/252 X |
| 5,186,516 | 2/1993 | Alexander et al. | 292/252 X |
| 5,214,945 | 6/1993 | Martin | 70/232 |
| 5,263,751 | 11/1993 | Priest et al. | 292/336.3 |
| 5,364,046 | 11/1994 | Dobbs et al. | 292/252 X |
| 5,542,273 | 8/1996 | Bednarz | 70/386 X |
| 5,586,794 | 12/1996 | Stillwagon | 292/252 |

FOREIGN PATENT DOCUMENTS

| | | | |
|---|---|---|---|
| 2105062 | 9/1970 | France | 70/386 |
| 2319758 | 2/1977 | France . | |
| 3736194 | 5/1989 | Germany . | |
| 3905353 | 8/1990 | Germany | 70/386 |
| 2267115 | 11/1993 | United Kingdom . | |
| WO9010774 | 9/1990 | WIPO . | |
| WO9100405 | 1/1991 | WIPO . | |

*Primary Examiner*—Suzanne Dino Barrett
*Attorney, Agent, or Firm*—Richard M. Goldberg

[57] ABSTRACT

A combined actuation lock includes an anchorage joined firmly and inseparably to ground; a rod insertable into the anchorage and including a mechanism for temporary coupling the rod with the anchorage, the mechanism including two through holes such that a part next to a lower end of the rod has two balls that can protrude through the holes, a vertically moveable core in the rod and including an axle having a cylinder and cap at opposite ends thereof, the cylinder having a conical pusher end, and the anchorage having a central part with an annular space that can retain the lower end of the rod when the balls protrude therefrom; and a body secured to a door, the rod firmly connected to the body, and the body including devices for activating opening and closing processes of the rod, the devices including a manual activation device having at least one external lock with a cam and a cover articulated about an axis, the cover including a recess which houses a protruding part of the lock, and an electrical operation device including an internal device commanded by an external impulse, the electrical operation device being fitted with an automatic interlocking device, the electrical operation device being connectable with a central electronic unit, wherein the manual activation device makes the cap on the axle rise via the cam, and the electrical operation device causes the core to rise.

18 Claims, 13 Drawing Sheets

COMBINED ACTUATION LOCK

BACKGROUND OF THE INVENTION

The present invention is directed to locks, and particularly those for locking doors whose closing operation is vertical, sliding or tilting. It is also directed to the field of locks for electrically operated doors.

E90904411 for an electrical lock operating device, especially for motor vheicles, is made up of an electric motor which drives an endless screw or worm unit. This is housed in a part of the frame of the device which forms one sole piece with the part of the frame which houses the electric motor.

Recently remote control units have become well-known in systems for unlocking vehicles for example. Outdoor blinds and vertical doors are operated at present by motors which avoid the human work of lifting and lowering these by hand.

Nevertheless locks which can combine both systems, that of motor-driven lifting and operation by remote control have not yet been heard of.

Unlocking this kind of lock and this kind of door involves a series of difficulties stemming from the fact that the lock action has to be internal, as otherwise the lock cannot be efficient because it could easily be forced. Furthermore, the fact that the blind or door mechanically separates from the lock presents problems stemming from the particular adjustment of each item, and as we will see further on in accordance with the solution for this problem.

SUMMARY OF THE INVENTION

This invention presents a combined operation lock which, though it can be mechanically operated, can also be run by remote control and is electrically operable, thus electronically determining the situation and anomalies of the locking operation.

There is also a description of an embodiment of the lock including a communication system using two codified units, one external and another in the lock, which are in a permanent dialogue situation, so that the motor can only be operated when both units are in proper communication, and including the set of internal and external devices for detection of the status of the door and consequently the means for carrying out opening or closing operations.

BRIEF DESCRIPTION OF THE DRAWINGS

It order to wake the explanation to follow clearer, thirteen sheets of drawings are enclosed, representing the essence of this invention in nineteen figures.

DETAILED DESCRIPTION

Figure 1:
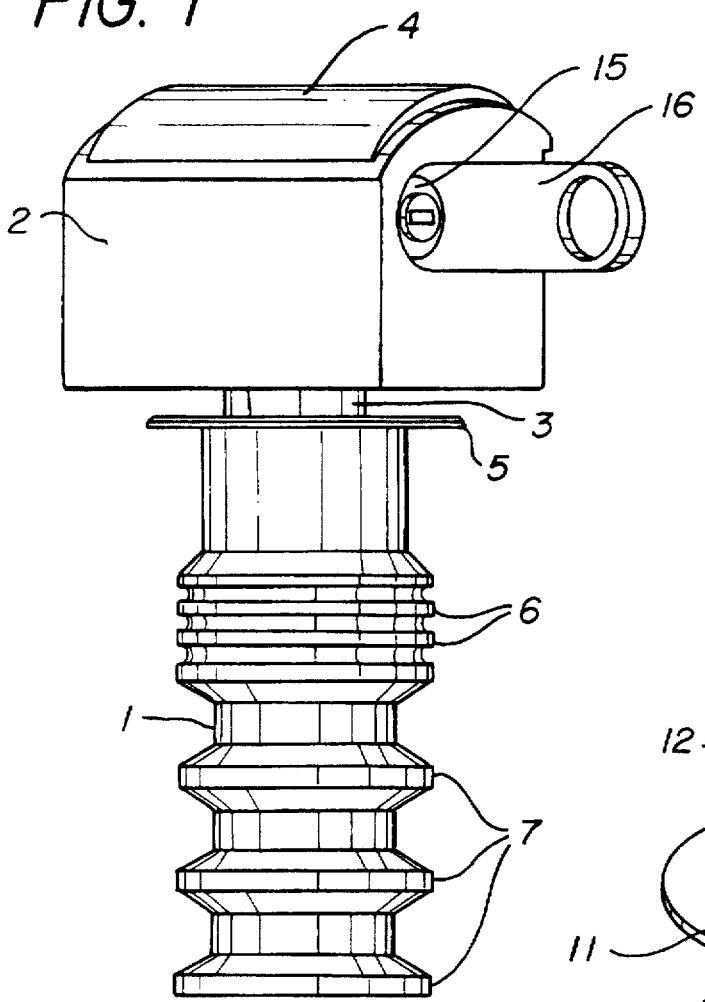
FIG. 1 shows an outside view of the assembly.
Figure 2:
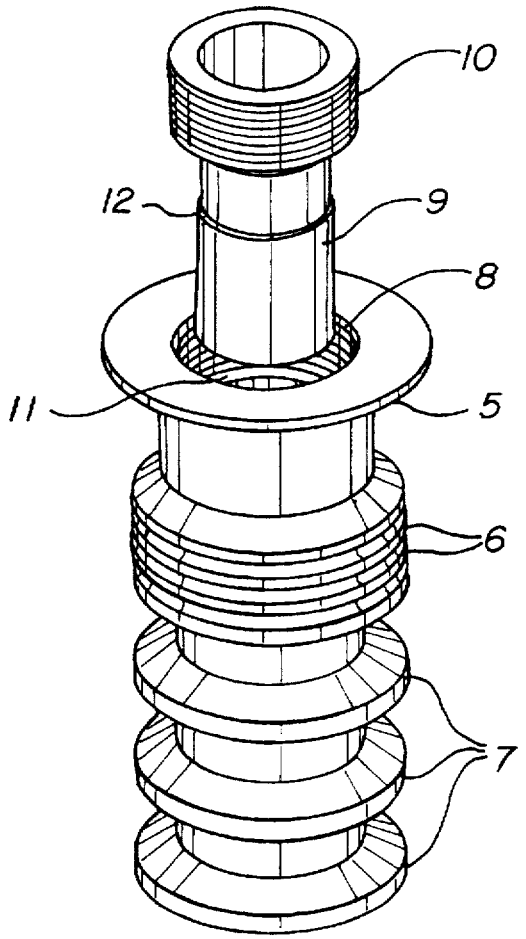
FIG. 2 shows an outside view of the assembly.
Figure 3:
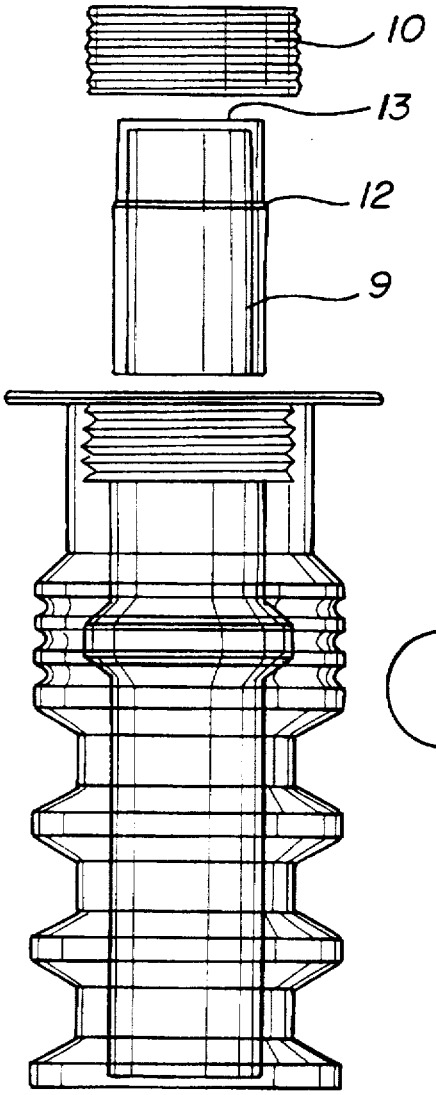
FIG. 3 shows a view of the anchorage with interior view.

In these FIGS. 1 indicates the anchorage, 2 the body, 3 the rod, 3.1 the rod of the double body, 4 the cover, 5 the edge of the anchorage, 6 the annular reinforcements of the anchorage, 7 the rings for securing the anchorage, 8 the inner thread of the anchorage, 9 the inner plunger of the anchorage, 10 the threaded ring or stop of the plunger, 11 the spring set underneath the plunger 9, and 12 the recess of the plunger, 13 being the upper surface of the plunger, 14 the balls for locking the rod in respect of the anchorage, 15 the side lock, 16 the cover of the side lock, 17 the rear lock, 18 the electrical connection, 19 the attachments for securing the locking assembly to the corresponding door, 20 the bar or axle of the triggering device, 21 the locking cam, 22 the axle of the core, 23 the cap, 24 the solenoid, 25 the core, 26 the electrical connection of the solenoid, 27 the waterproofing seal, 28 the vertical wall of the upper part of the bar or code axle of the trigger device, 30 the cone joined to the cylinder 29 or pusher, 31 the detector of the position of the locking device, 32 the thread of the rod, 33 the acute shape of the cap along its lower edge, 34 being the detector arm, 35 the retaining pawl, 36 the ball of the trigger device, 37 the upper housing of the ball, 38 the upper form of the bar or axle of the triggering device, 39 the rear spring of the pawl, 40 the stop of the bar or axis of the trigger device 20, 41 the guide of the bar or axle of the trigger device 20, 42 the rounded lower shape of the pawl, 43 the angular or sharp shape of the retaining pawl, 44 the recess for the retaining pawl, 35, 45 the cable guide hole for connection to the cover, 46 being the electrical connection of the cover 4, 47 the attachment of the rod 3 to the body 2, 48 being the inner shape of the anchorage which can accommodate the balls 14, 49 the through holes of rod 3, 50 the annular narrowing formed in the outer parts of said through holes and 52 being the upper spring of the cap 23, 53 being the recoil spring of the bar or axle of the trigger device, 54 the pawl 35 travel retainer, 55 the body in the preferential embodiment which seen in plan view has a trapezoidal shape 56 being the pusher bar, 57 the upper part of the cap, 58 the core, 59 the top of the pusher 30, 60 the lower part of the cap, 61 the neck of the core, 62 the return spring of the top of the cap, 63 being the housing for the electronic part, 64 the wedge of the trigger mechanism, 65 the slot for allowing the electronic detectors through, 66 the housing of the cylinder of the manual lock, 67 the housing of the core and opening system, 68 the wedge shaped space for housing the electronic part in hollow 63, 69 being the cover of the electronic section which is to be fitted with a cable guide, 70 being the thumb latch, 71 the thumb latch stabilizing pin, 72 the spring, 73 the pivot of the cam, 74 the core tube, 75 the thumb latch spring, 76 the ball, 77 the hole for the cam pivot, 78 the upper hollow of the ball travel for its housing, 79 the contacts for locking detection, 80 the contacts for detection of impulses prior to the locking command, 81 the cover of the lock, and 82 the electronic circuit board.

Figure 4:
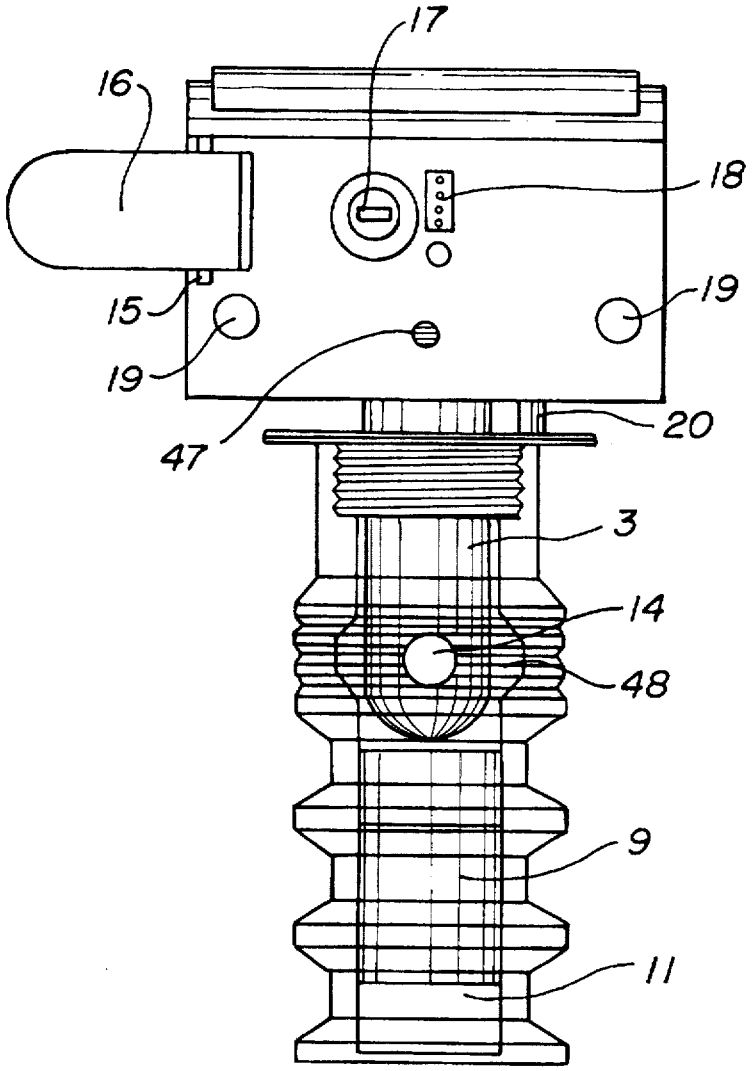
FIG. 4 shows a view of the anchorage in perspective with the rod inserted into the anchorage.
Figure 5:
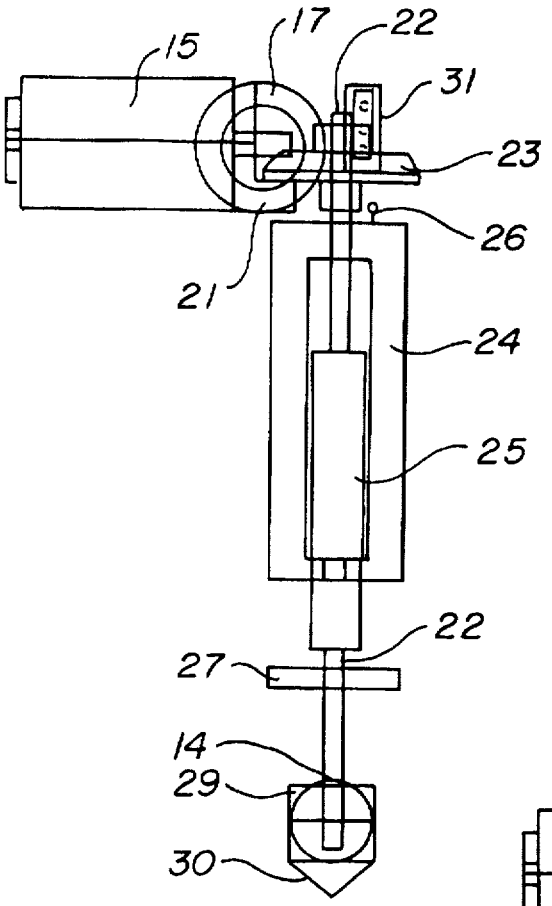
FIG. 5 shows a schematic view of the structure of electrical and mechanical operation.
Figure 6:
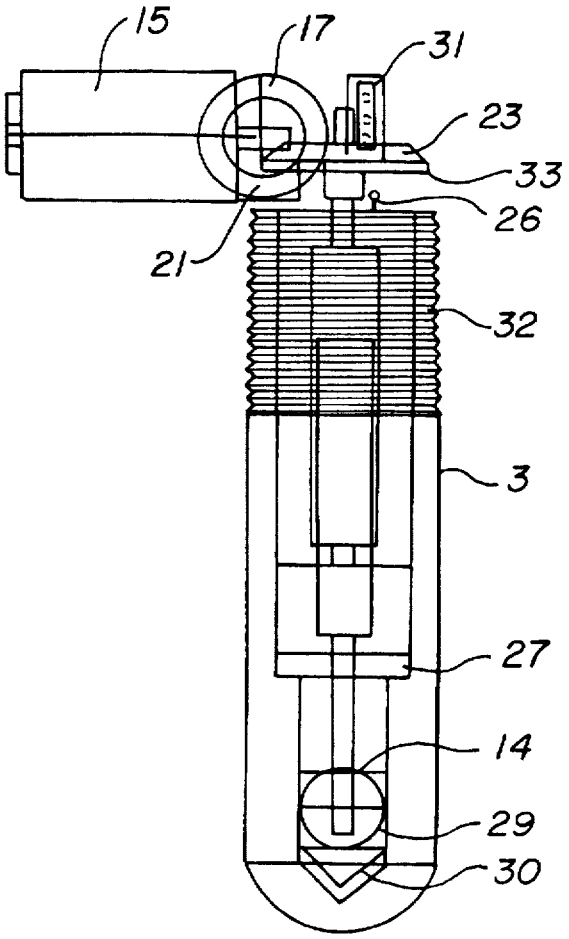
FIG. 6 shows a schematic view of the electrical and mechanical operation according to its position on the rod.
Figure 7:
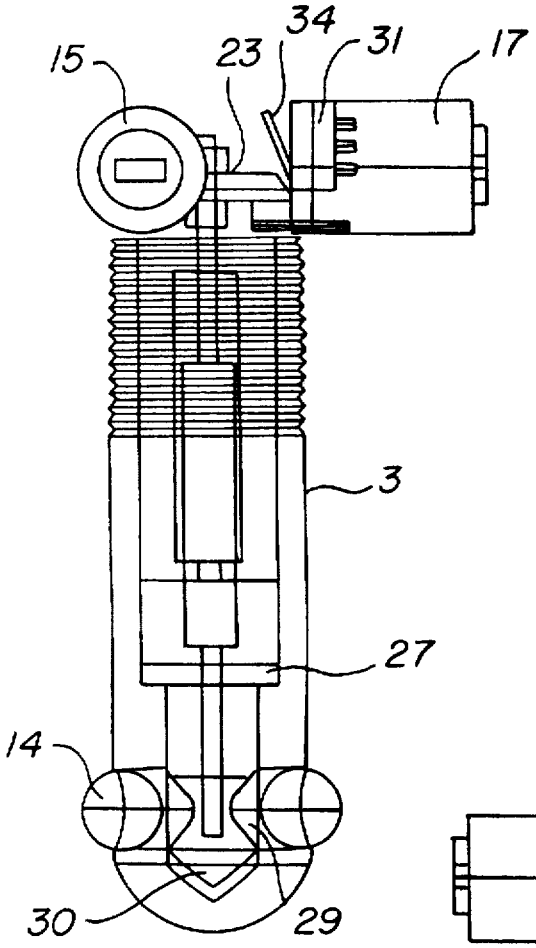
FIG. 7 shows a view perpendicular to the previous one in closed position.
Figure 8:
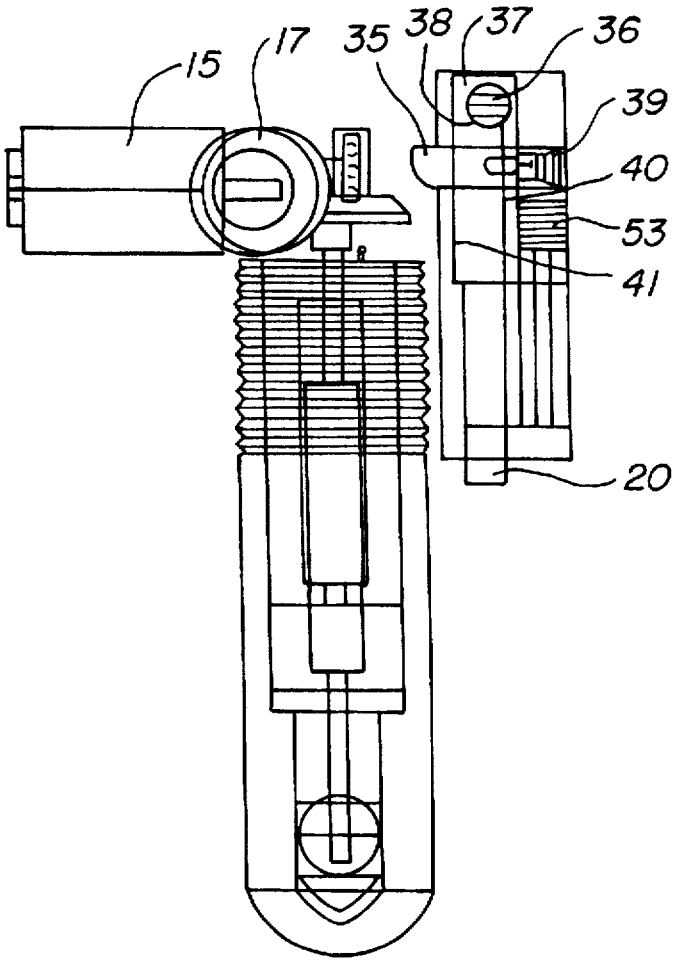
FIG. 8 shows a schematic view of the locking device with the automatic retaining device assembly for locking.
Figure 9:
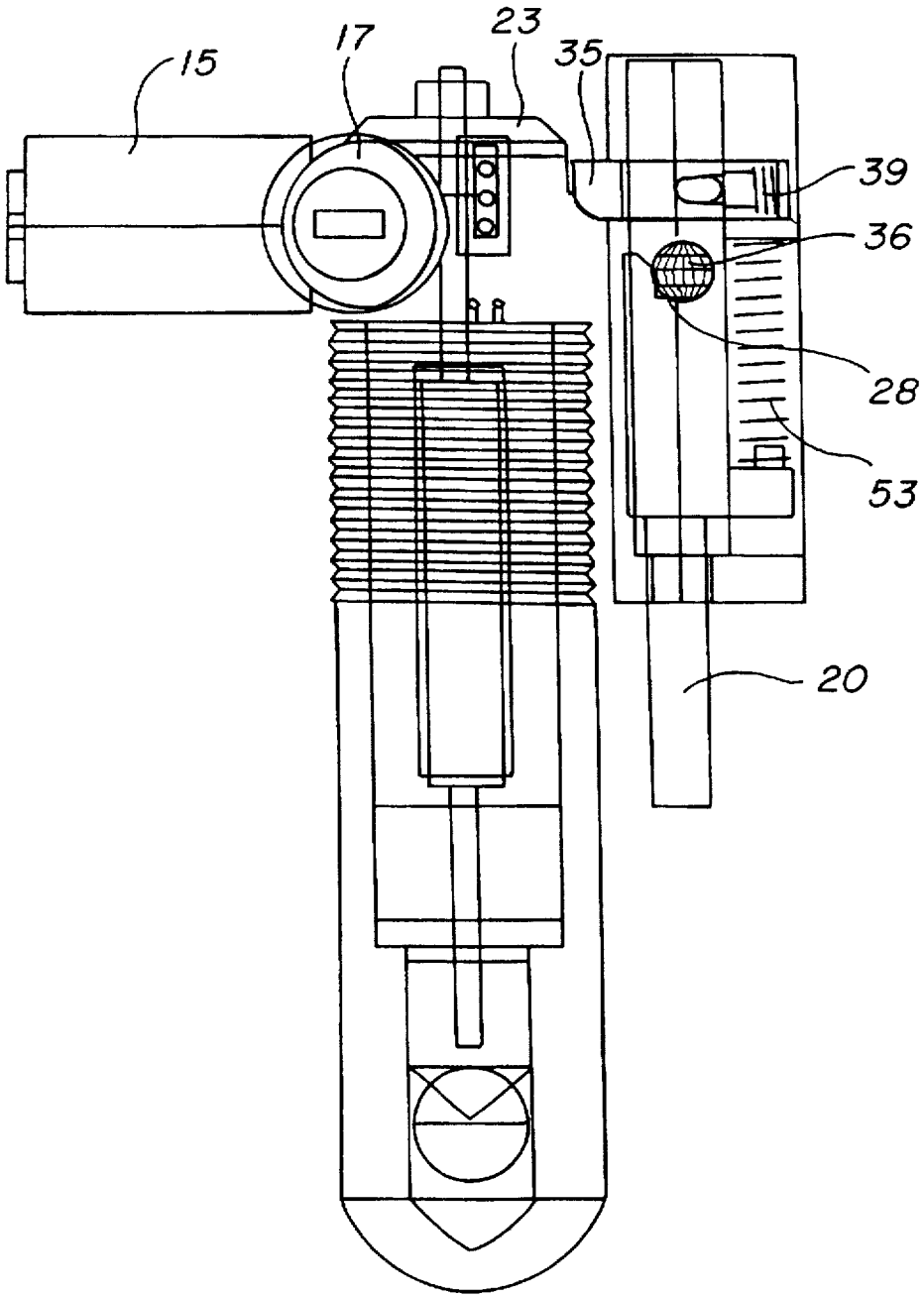
FIG. 9 shows a schematic view of the assembly shown in the previous figure in the open position.
Figure 10:
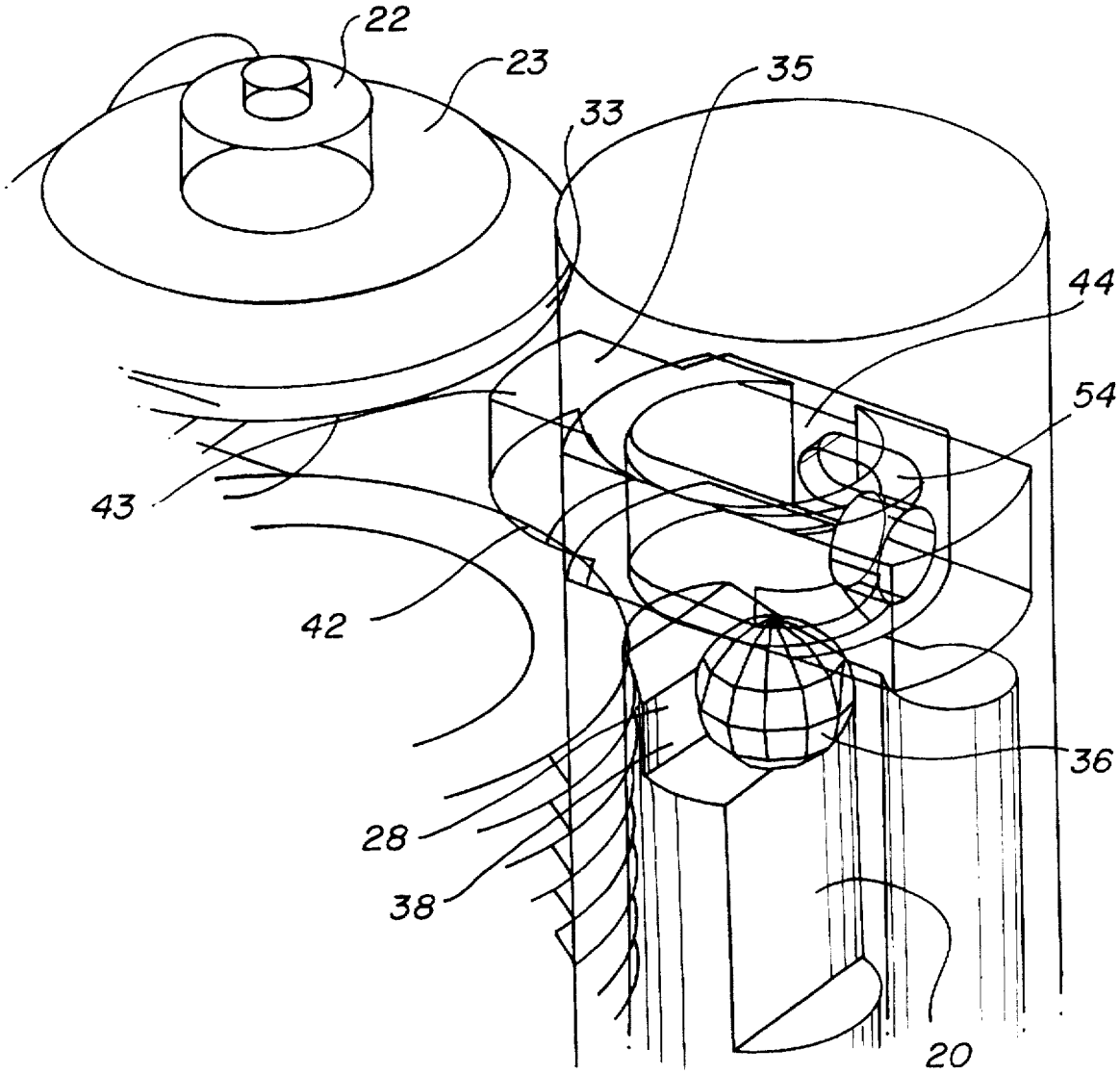
FIG. 10 shows a view of the automatic locking retaining assembly in the open position.
Figure 11:
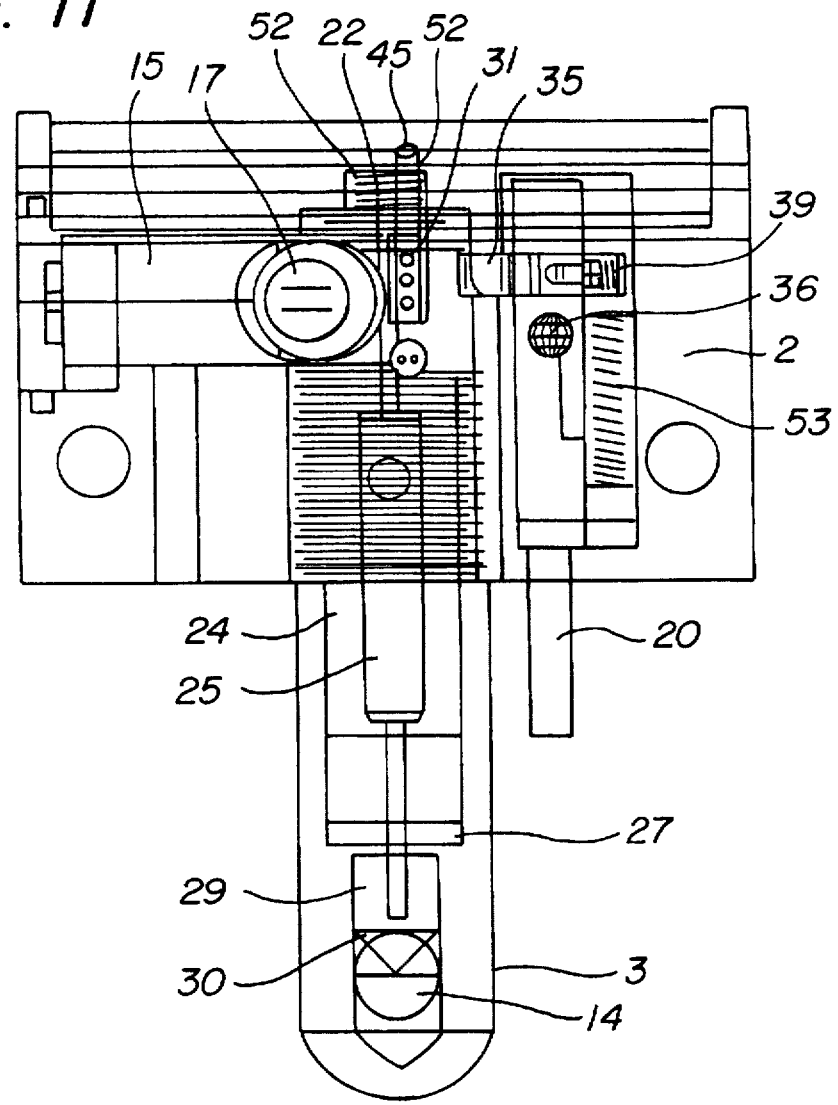
FIG. 11 shows a schematic view of the assembly from the side.
Figure 12:
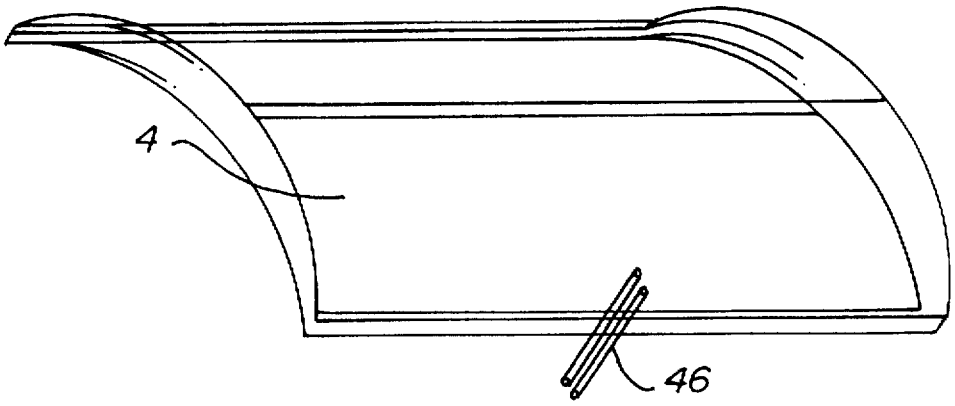
FIG. 12 shows a view of the cover.
Figure 13:
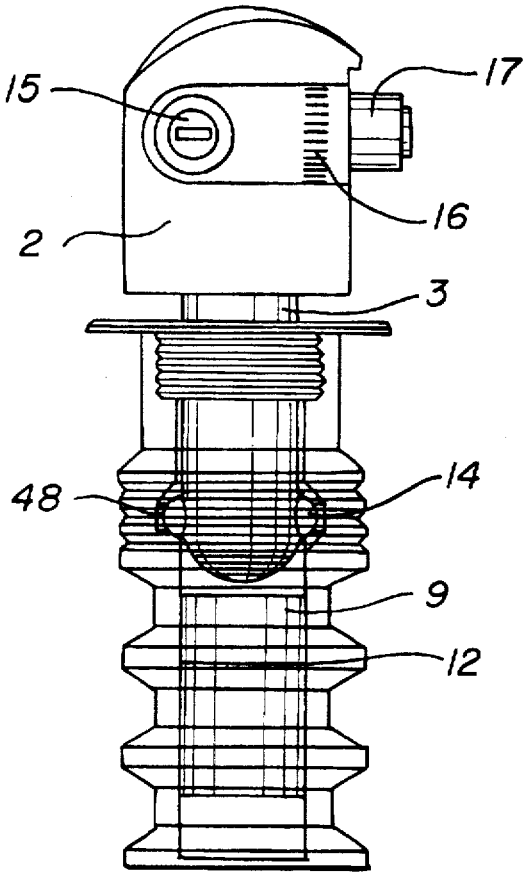
FIG. 13 shows a view of the assembly in which the locking of the rod in the anchorage can be seen.
Figure 14:
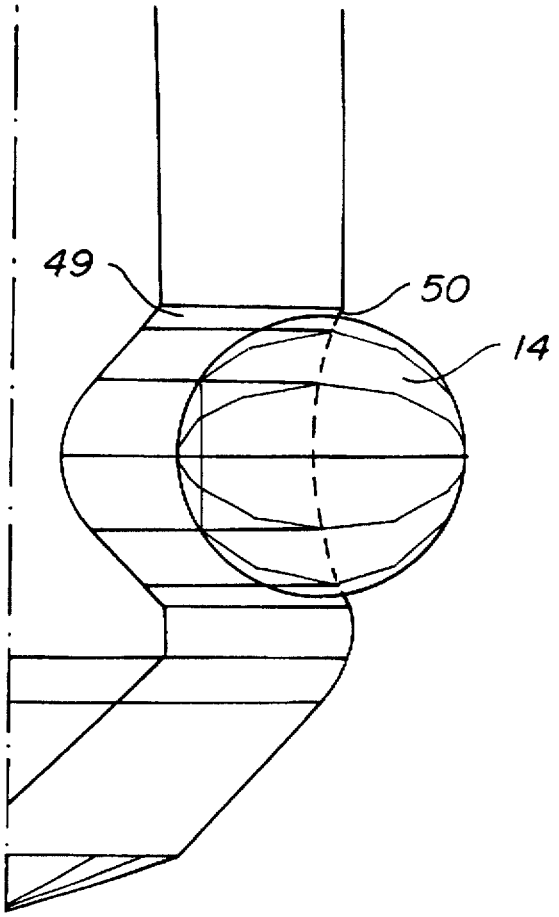
FIG. 14 shows a detail of the balls.

The anchorage 1 has a central form fitted with annular reinforcements 6, whose lower part has rings 7 for securing these, and its upper part has an edge 5 which aligns with the outer surface of the place in which this is encased. This can be of the type which is threaded to the body of the anchorage 1. The inner part with its annular reinforcements 6 has an internal widening 48 which can retain the balls 14 held in the rod when these come through the ports opening in the lower side of said rod. The anchorage has an internal plunger 9 set on a spring 11 which has a recess 12 which limits its travel upwards in respect of a threaded ring 10 which is inserted in the inner thread 8. Through the effect of an upward pressure the upper surface of said plunger 13 gives way until it is lodged in the lower end of the anchorage (FIG. 4).

The rod 3 is joined by means of a thread 32 to the body 2, and can be locked by means of fixing 47. This thread can also constitute a regulation of the length of the rod 3. Said rod 3 contains the devices for locking and unlocking in respect of the anchorage.

One embodiment of the rod 3 could be joined by means of a pin device with the same effect.

The assembly has for example one or two locks: when installed in a door, one of these is in a position to be operated from the inside of the premises and the other, fitted with a cover 16, from the outside.

The body 2 operates the assembly for the corresponding closing and opening operations. It can be operated by means of the outdoor lock 15, by the indoor lock 17 and by an electrical impulse.

The advertising and informative cover is a part that can be lit up but is not inherent to the locking device strictly speaking, and is formed of a cover which matches the body 2 in shape and size, and has a channel 45 through which cables can be threaded for its electrical connection 46. It has selective lighting and for example words such as "open" or "closed" or alarm or locking failure symbols.

The part next to the end of the rod 3 has two balls 14 that can protrude through the two through holes 49, of greater diameter than these and becoming narrower at their outer ends by annular neckings 50, which enable a range of movement covering the cylindrical space lying between them, without letting them drop out.

Figure 15:
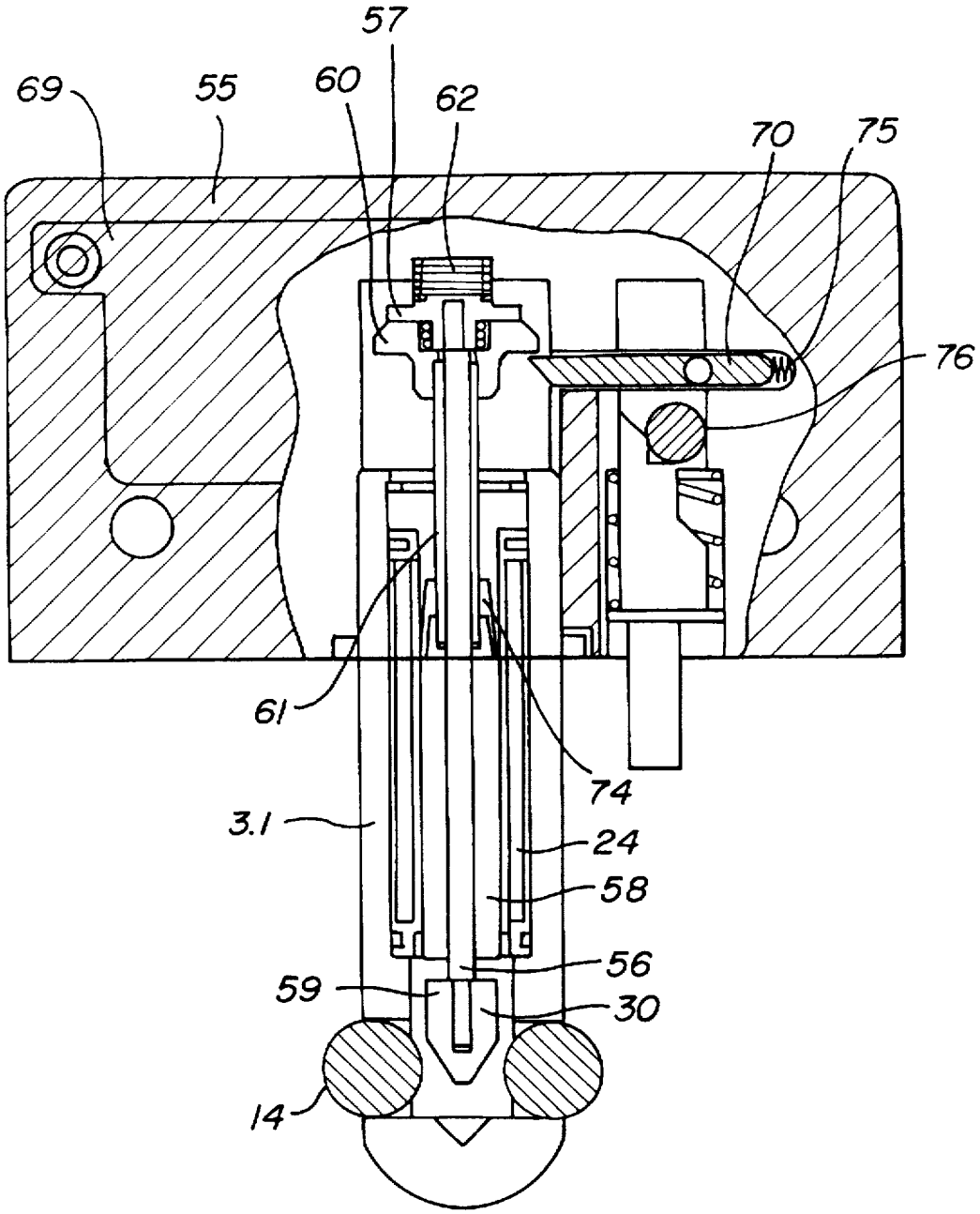
FIG. 15 shows a front view whose cutaway enables the internal part of a preferential embodiment to be seen.
Figure 16:
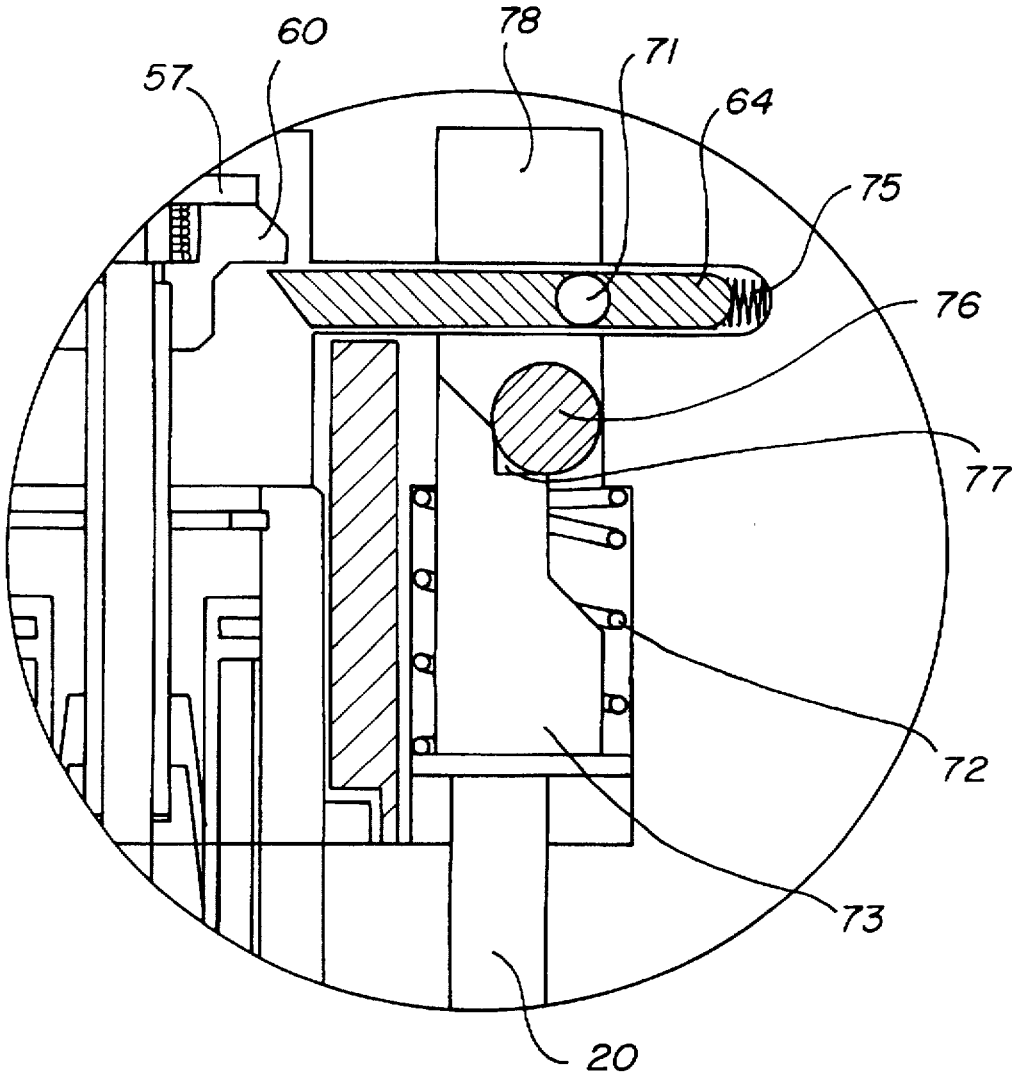
FIG. 16 shows a section and detail of the triggering mechanism according to a preferential embodiment.
Figure 17:
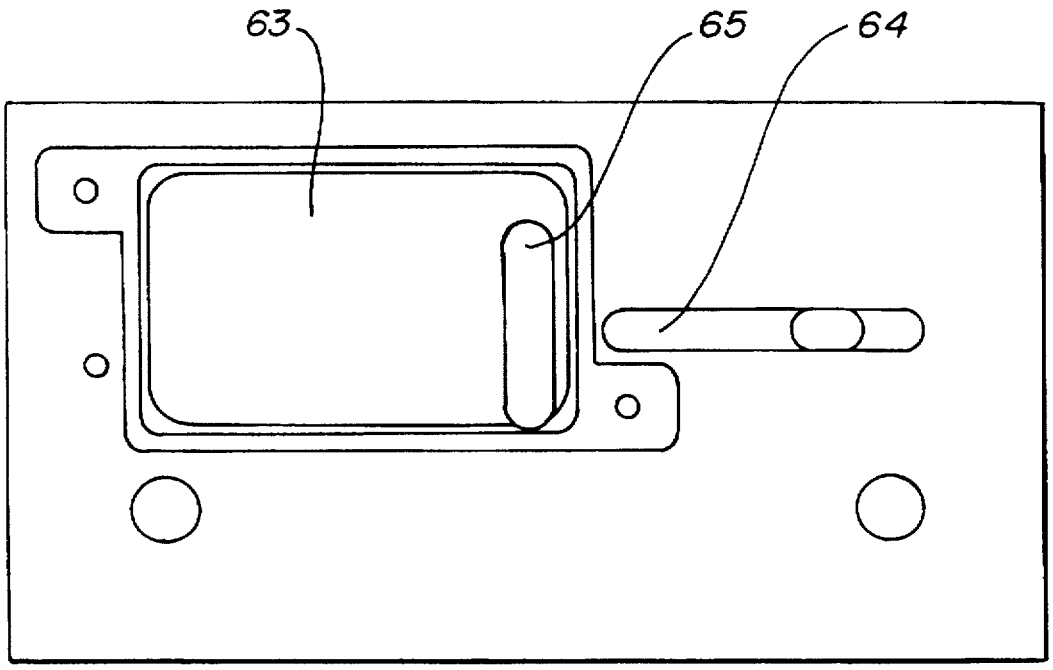
FIG. 17 shows the rear part of the body in the preferential embodiment.
Figure 18:
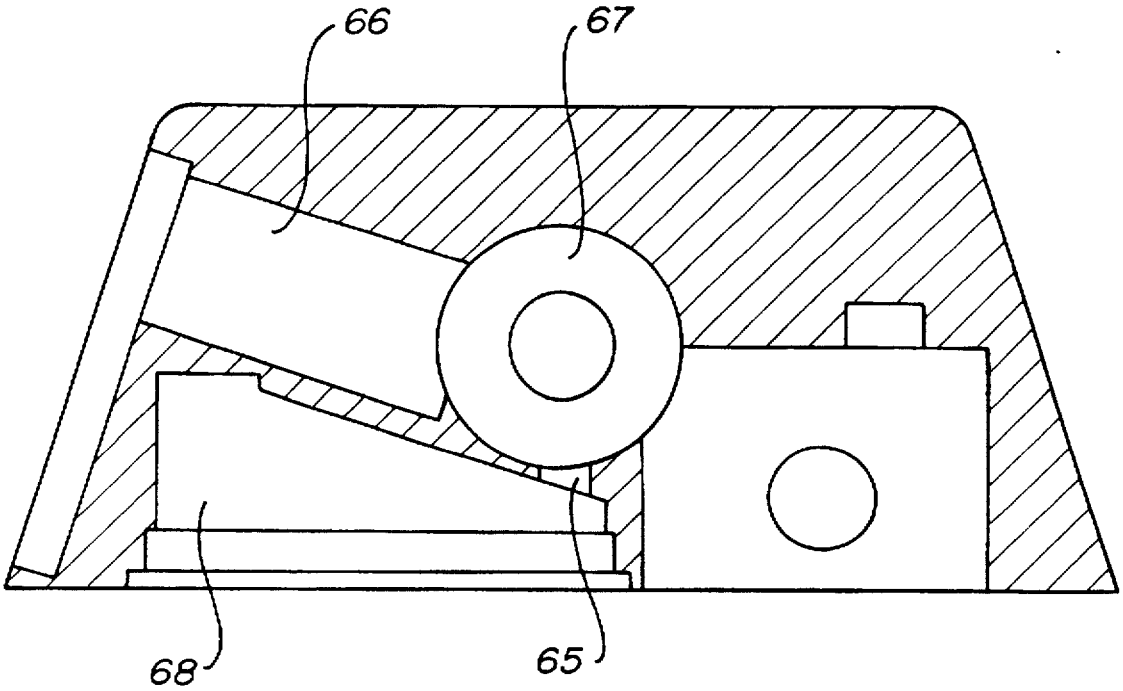
FIG. 18 shows a section view of the cover in which the housing for the electronic system of the lock is set.
Figure 19:
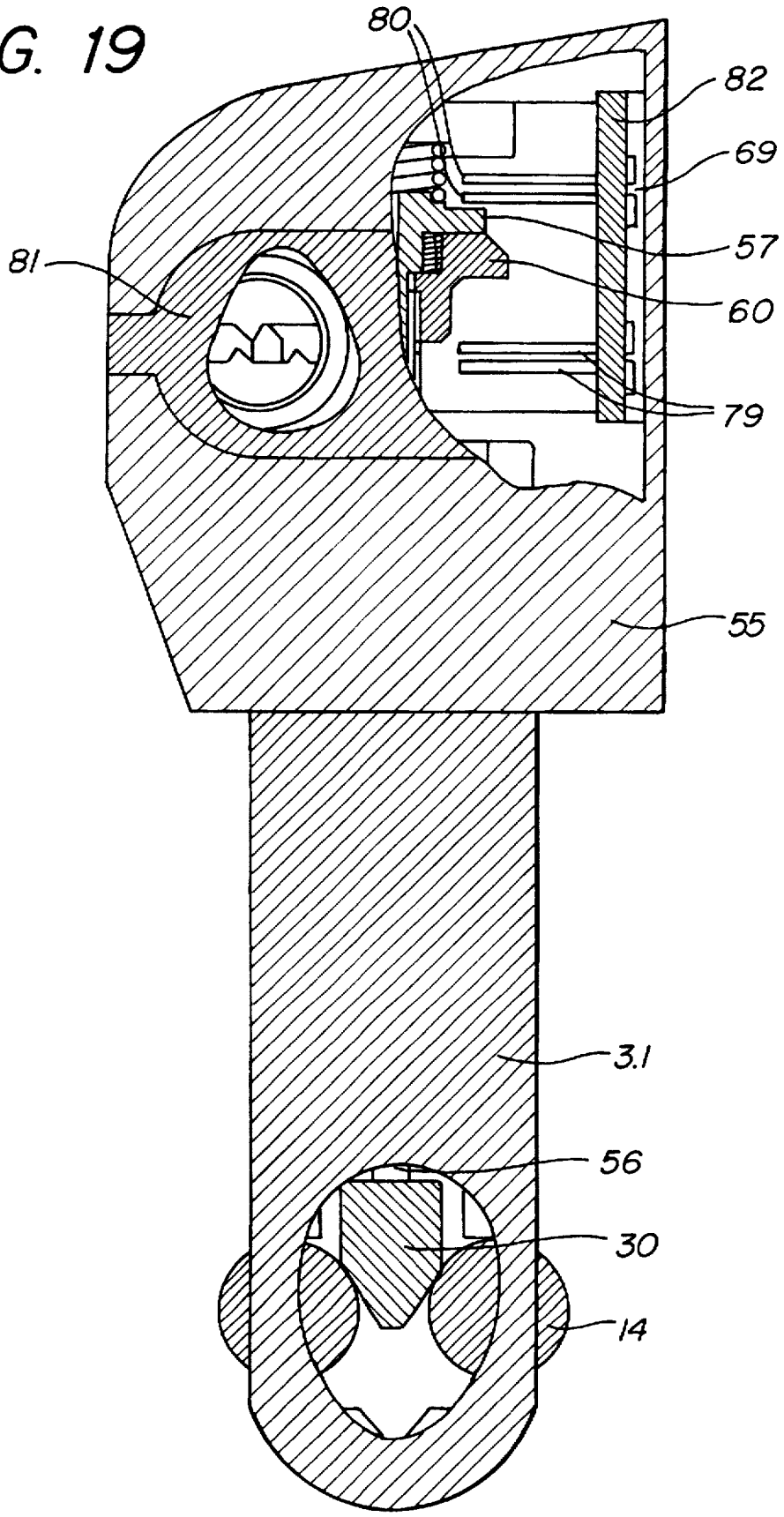
FIG. 19 is a side view with a cutaway which shows a cross-section of the arrangement of the electronic board and contacts.

A preferential embodiment consists in the one shown in FIG. 15 and 19, which will now be explained.

This embodiment is totally based on the electronic configuration of the two units, lock and motor control. According to this basic scheme, there needs to be a microprocessor in the lock, which is set in the housing 63, and a microprocessor in the outer unit, not shown. The logical system for communication between both microprocessors is highly complex, but can be schematically expressed in such a way as to outline the basic functions. Both microprocessors establish a dialogue so that they can recognize each other. Apart from the recognition code, the lock sends out a status code, which enables the outer unit to react according to said status. One special function of the lock processor is to inform of the lock status. Whether dealing with one or two locks, the motor must be aware that the door lock is open, to allow motor-driven opening, for if not the motor could operate inefficiently, burn out and furthermore not open the door. For this reason, in this function, when the remote control unit informs is that it should open, the motor gives the order to the lock to open. If the lock does not open, it informs the motor of this circumstance. The motor turns in reverse to free the balls 14 from its tension. The verification process is continuous, especially if there are two or more locks on the same door. When it receives the information that both are open, the motor lifts for the time required and predetermined for the door to be opened.

The closing operation is carried out by means of a similar function the other way round. Form the top position, the closing order determines the order in the motor to lower the door. Detection in the motor of the operation being concluded takes place by means of the pressure of the rod 20, and a combination of codified impulses which identify the proper closing. The limiter is bar 20. Otherwise, if the coding is not correct, the electronic device gives an order to reactivate the system, being set open again and ready to receive the closing codes. A detector 79, 80 connected to the electronic system, verifies the impulses, so that the door is left closed. Said impulses are made, in respect of the contact 80, by the top of the cap which commands the bar 56 of the pusher moved by the pusher 30 in relation with the movement of the balls on going through the narrowing of the anchorage 1; as regards the contact 79, by the lowering process, caused by releasing the thumb latch 70 which holds underneath the bottom of the cap 60. The thumb latch 70 has a pin 71 which is contacted by the ball 76 on being pushed by rod 20 set in a recess 77 formed by the cam pivot 73, temporarily moving the thumb latch by the lifting motion, and said latch returns to tis initial position by means of the spring 75. Once at the top the ball is free to drop, recovering the hollow 77, and becoming operative once more. The triggering for the closing operation acts in this way. Nevertheless the closure is definitively determined as follows: said detector has the two contacts already mentioned, one at the top 80 and one at the bottom 79. Closing occurs when both are in agreement, as if the lock were to be manually triggered by means of the closing rod 20, closure of the lower contact 79 would occur without the upper one having received the coding, so that the electronic system would give the reactivation order, lifting the cap to the top position waiting for the mechanical triggering to be in accordance with the electronic prompt.

This can be used in industrial applications for making lock closure devices and especially those which are combined with motor-driven and/or manually operated movement doors.

I claim:

1. A combined actuation lock comprising:

an anchorage joined firmly and inseparably to ground, a rod that can be inserted into the anchorage in an axial direction of said rod and anchorage, said rod including a mechanism for temporary coupling of said rod with and separation of said rod from the anchorage, and a body secured to an object to be opened and closed in said axial direction, said rod being firmly connected to said body, and said body including devices for activating opening and closing processes of said rod, said devices including:

a manual activation device including at least one external lock with a cover articulated about an axis, said cover including a recess which houses a protruding part of a cylinder of the lock with which said cover coincides, and an electrical operation device including an internal device commanded by an external impulse, said electrical operation device being fitted with an automatic interlocking device, said electrical operation device being able to be connected with a separate central electronic unit.

2. A combined actuation lock according to claim 1, wherein:

said mechanism of said rod includes:

at least one through hole at a lower end of the rod, at least one ball that is able to partially protrude through said at least one through hole in said rod, said at least one through hole being of greater diameter than said at least one ball and narrowed at outer ends thereof to prevent total escape of the at least one ball therefrom, a vertically moveable core including an axle having a cylinder at one end thereof, said cylinder having a conical pusher as a prolongation of the cylinder, and said core inseparably mounted to said rod, and the anchorage includes a central part thereof with an annular space that can lodge and retain the lower end of the rod when the balls protrude therefrom, as a result of a lower position of the axle of the core so as to lock the rod in the anchorage.

3. A combined actuation lock according to claim 1, wherein the rod has a thread at a top end thereof for joining the rod to the body and which determines a longitudinal positioning of the rod, and further comprising a locking device, for fixedly securing the rod with the body, said locking device including one of a pin and stud-bolt device.

4. A combined actuation lock according to claim 2, wherein said at least one external lock includes a side lock and a rear lock, at least one lock having a cam, further comprising a cap fixed on said axle, wherein the manual activation device makes said cap on said axle rise by the cam of either of the locks, and the electrical operation device causes the core to rise, further comprising:

a lateral pawl for holding the cap in a raised position, and a position detector for detecting the position of the cam; and wherein:

the rod has a solenoid outside the core; and the position detector can transmit information on an inner status of the axle position, including open, closed and improperly closed.

5. A combined actuation lock according to claim 4, wherein:

the cap has a curved shape at a top thereof and an angular shape at a bottom thereof;

the pawl is permanently set in a line of movement of the cap, and has a rounded shape at a bottom thereof and an angular shape at a top thereof, for retaining the cap which has said curved shape at the top and said angular shape at the bottom;

a spring is provided for activating the pawl; and the position detector has a sensor arm which is pressed or released by a profile of the cap.

6. A combined actuation lock according to claim 4, wherein the pawl has a hole, and further comprising:

a triggering device having a bar, a triggering ball that is permitted free descent and ascent through said hole of said pawl and which can move vertically upwards to be lodged on an upper end of the bar of the triggering device such that rising motion of the bar causes horizontal movement of the pawl, determining a separation of the pawl with the cap which was retained by said pawl, a spring which pushes a rear portion of the pawl, and said bar of the triggering device having a lower end in a position ready to be closed, said bar substantially protruding from the body and having an upper end with a shape which can temporarily house the triggering ball, said shape having a structure with a wedge shape on one side which determines a vertical wall and a base perpendicular to said vertical wall, with the ball being able to fit between said vertical wall and said base.

7. A combined actuation lock according to claim 2, wherein the axle has at a bottom thereof a seal on the rod between (a) the through holes through which the balls come out and (b) a bottom end of the core.

8. A combined actuation lock according to claim 1, further comprising a publicity cover over the body that can house luminous media for indications of status and advertising, and having an electrical communication with an inside of the body which is channeled through a hole through which cables travel within the body, which is covered by said cover, said cover being solid.

9. A combined actuation lock according to claim 2, wherein said body is fitted with a lock cover and has a trapezoidal shape in plan view, said body having on an inside thereof a retention wedge in an open position which is formed by a thumb latch which has a pin able to be laterally pushed temporarily by downward pressure of a ball, housed in a recess of a cam pivot, said cam pivot being connected with a triggering bar, said thumb latch retaining a bottom of a cap which is made up of an upper part linked with a pusher bar of the pusher and a lower part linked with the core; the pusher bar being movable in a highest position of elevation of the core, so that the pusher bar lifts the upper part of the cap, separating said upper part of the cap from the lower part of the cap located at the highest position and retained by the wedge and producing an impulse in a contact connected with an electronic part; said electronic part having a contact under the former, which can be activated by a skirt of the lower part of the cap in the bottom position thereof and is covered by a cover which has a cable guide for connecting to a separate central electronic unit commanding a motor.

10. A combined actuation lock according to claim 4, wherein, for lifting a door to which said body is secured, a separate central electronic unit commands an initial impulse for lowering the door, after which electrical activation of the solenoid determines the lifting of the core, and after which the door is lifted through inversion of the initial impulse.

11. A combined actuation lock according to claim 2, wherein said anchorage includes a lock which is comprised of a plunger that can move into the anchorage, and which is positioned on a recovery spring, said plunger having an annular recess which determines a leveling flush with a surface of a threaded ring, which comprises an outer part of said lock.

12. A combined actuation lock comprising:

an anchorage joined firmly and inseparably to ground, a rod that can be inserted into the anchorage in an axial direction of said rod and anchorage, said rod including a mechanism for temporary coupling of said rod with and separation of said rod from the anchorage, said rod including:

at least one through hole at a lower end of the rod, at least one ball that is able to partially protrude through said at least one through hole in said rod, said at least one through hole being of greater diameter than said at least one ball and narrowed at outer ends thereof to prevent total escape of the at least one ball therefrom, a vertically moveable core including an axle having a pusher at one end thereof for pushing said at least one ball partially out of said at least one opening, and said core inseparably mounted to said rod, a body secured to an object to be opened and closed in said axial direction, said rod being firmly connected to said body, and said body including at least one actuation device for activating opening and closing processes of said rod, and the anchorage including a central part with an annular space that can lodge and retain the lower end of the rod when the balls protrude therefrom, as a result of a lower position of the axle of the core so as to lock the rod in the anchorage.

13. A combined actuation lock according to claim 12, wherein the rod has a thread at a top end thereof for joining the rod to the body and which determines a longitudinal positioning of the rod, and further comprising a locking device, for fixedly securing the rod with the body, said locking device including one of a pin and stud-bolt device.

14. A combined actuation lock according to claim 12, wherein said at least one actuation device includes a manually activated lock and an electrical operation device, the manually activated lock having a cam, further comprising a cap fixed on said axle, wherein the manually activated lock is adapted to make said cap on said axle rise by said cam, and the electrical operation device can cause the core to rise, further comprising:

a lateral pawl for holding the cap in a raised position, and a position detector for detecting the position of the cam; and wherein:

the rod has a solenoid outside the core; and the position detector can transmit information on an inner status of the axle position, including open, closed and improperly closed.

15. A combined actuation lock according to claim 14, wherein:

the cap has a curved shape at a top thereof and an angular shape at a bottom thereof;

the pawl is permanently set in a line of movement of the cap, and has a rounded shape at a bottom thereof and an angular shape at a top thereof, for retaining the cap which has said curved shape at the top and said angular shape at the bottom;

a spring is provided for activating the pawl; and the position detector has a sensor arm which is pressed or released by a profile of the cap.

16. A combined actuation lock according to claim 14, wherein the pawl has a hole, and further comprising:

a triggering device having a bar, a triggering ball that is permitted free descent and ascent through said hole of said pawl and which can move vertically upwards to be lodged on an upper end of the bar of the triggering device such that rising motion of the bar causes horizontal movement of the pawl, determining a separation of the pawl with the cap which was retained by said pawl, a spring which pushes a rear portion of the pawl, and said bar of the triggering device having a lower end in a position ready to be closed, said bar substantially protruding from the body and having an upper end with a shape which can temporarily house the triggering ball, said shape having a structure with a wedge shape on one side which determines a vertical wall and a base perpendicular to said vertical wall, with the ball being able to fit between said vertical wall and said base.

17. A combined actuation lock according to claim 12, wherein the axle has at a bottom thereof a seal on the rod between (a) the through holes through which the balls come out and (b) a bottom end of the core.

18. A combined actuation lock according to claim 12, further comprising a publicity cover over the body that can house luminous media for indications of status and advertising, and having an electrical communication with an inside of the body which is channeled through a hole through which cables travel within the body, which is covered by said cover, said cover being solid.

* * * * *